United States Patent [19]

Kittleson

[11] Patent Number: 4,679,024

[45] Date of Patent: Jul. 7, 1987

[54] POTENTIOMETER CONTACT WIPER

[75] Inventor: Karl A. Kittleson, Northwood, Iowa

[73] Assignee: Northern Engineering, Inc., Northwood, Iowa

[21] Appl. No.: 781,266

[22] Filed: Sep. 27, 1985

[51] Int. Cl.[4] ..... H01C 10/30

[52] U.S. Cl. ..... 338/160; 338/171; 338/172; 338/176

[58] Field of Search ..... 338/171, 172, 195, 202, 338/160, 176

[56] References Cited

U.S. PATENT DOCUMENTS

| | | | |
|---|---|---|---|
| Re. 31,431 | 10/1983 | Gass | 338/171 X |
| 2,257,445 | 9/1941 | Abrahamson | 201/62 |
| 2,447,780 | 8/1948 | Underwood et al. | 201/56 |
| 2,813,956 | 11/1957 | Sorber | 201/56 |
| 2,916,715 | 12/1959 | Nunn | 338/41 |
| 2,952,827 | 9/1960 | Semple et al. | 338/183 |
| 3,704,436 | 11/1972 | Froebe et al. | 338/202 |
| 3,757,266 | 9/1973 | Newman et al. | 338/158 |
| 3,766,646 | 10/1973 | Froebe et al. | 29/630 E |
| 4,051,453 | 9/1977 | Barden | 338/171 |
| 4,403,133 | 9/1983 | Turner et al. | 338/195 X |

FOREIGN PATENT DOCUMENTS

| | | | |
|---|---|---|---|
| 510796 | 8/1939 | United Kingdom | 338/171 |

*Primary Examiner*—E. A. Goldberg
*Assistant Examiner*—M. M. Lateef
*Attorney, Agent, or Firm*—Merchant, Gould, Smith, Edell, Welter & Schmidt

[57] ABSTRACT

A potentiometer which includes a wiper element having a plurality of contact fingers each mounted for wipeable engagement with a cermet resistance element deposited on a ceramic substrate. The contact fingers of the wiper element are each bent so that the end surface thereof, as opposed to a circumferential surface, is in wipeable engagement with the resistance element.

19 Claims, 6 Drawing Figures

FIG. 1
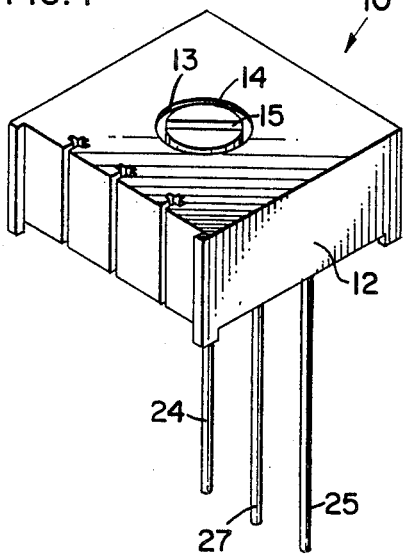
FIG. 2
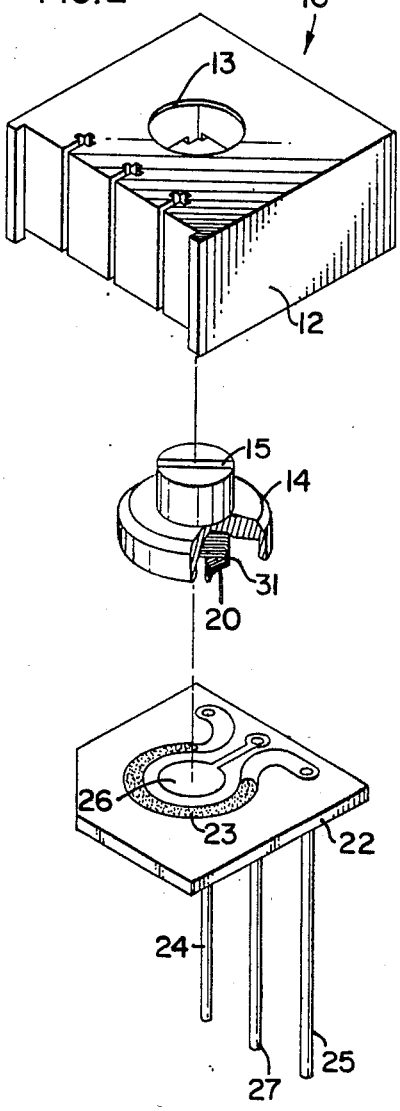
FIG. 3
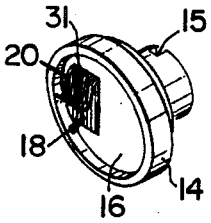
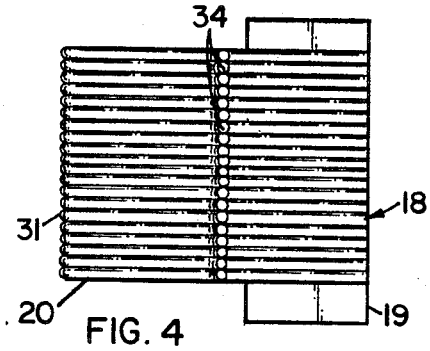
FIG. 4

POTENTIOMETER CONTACT WIPER

TECHNICAL FIELD OF THE INVENTION

The present invention relates generally to variable resistance devices or potentiometers, and more particularly to cermet potentiometers.

BACKGROUND OF THE INVENTION

Cermet potentiometers are characterized by a thick film resistance element deposited over a substrate which is typically alumina and a contact device or wiper which takes the form of a strip-like array of wires each acting as an individual contact finger. The cermet consists of a mixture of glass frit and precious metal particles suspended in a organic type emulsion solution which is silk-screened onto the substrate and then fired. The organic carrier burns off leaving a glass with the metal particles suspended. The ratio of metal particles to glass determines the resistivity of the cermet after firing.

The multifinger contact designs used in cermet potentiometers exhibit lower contact noise than single contact designs because the individual fingertips track the surface of the cermet independently. This eliminates much interruption of contact and the "make and break" noises associated with such interruptions. An example of such an array may be seen in U.S. Pat. No. 3,704,436 to Froebe et al, issued Nov. 28, 1972. The multifinger design provides greater uniformity of contact area and pressure as the wiper passes across the resistance element, resulting in less contact resistance and contact noise. For those skilled in the art such noise is known as contact-resistance-variation or CRV.

As it has been for many years, the uniform practice in the art today is to provide a small semicircular bend at the free end of each contact finger so that the fingers track the resistance element along its side or circumferential surface, as for example illustrated in the Froebe et al patent. While this has been a longstanding practice in cermet potentiometer design the rather severe abrasiveness of the resistance elements makes the practice less than ideal because a measureable portion of the contact finger is actually ground off during each pass of the wiper across the element. Unfortunately, what starts out as a relatively small elliptical area of contact between the abrasive cermet surface and the curved side of each wire finger quickly enlarges as the wiper scrapes back and forth over the abrasive surface of the resistance element. Obviously, the abrasion occuring during each turn of the potentiometer causes all the elliplical contact zones to systematically increase while their contact pressures must decrease due to the constancy of the applied spring force. This translates directly into a systematic drift in noise characteristics and possibly in calibration as well, both of which are undesireable in most applica- tions.

Moreover, the contact fingers can also fail catastrophically when the wires are worn substantially or entirely through from one side to the other. Of course, catastrophic failure of this nature when the potentiometer is in an electrical system is always bothersome and even potentially dangerous as one well might imagine.

SUMMARY OF THE INVENTION

The present invention provides a multiwire potentiometer contact wiper which solves the above-identified problems with semicircular contact tip designs. In addition, the wiper design of the present invention achieves considerably less tracking or adjustment noise, and provides improved tracking of the resistance element by the contact fingers which are conveniently distributed along the ends of the wire array. To accomplish these advantages the present invention provides a wire array wiper formed from a plurality of closely spaced, parallel resilient contact fingers supported from a bus bar. The bus bar and array are supported in a potentiometer so that the tip of each wire is biased against the resistive element. The contact fingers are each bent so that the tips of the axes of the wires are perpendicular to the contact surface. This assures a circular contact area that does not change as the tips wear down. Thus, the contact pressure and contact resistance of each wire remains constant even as the tips wear down.

Thus, the contact wiper of the present invention as described above provides for improved finger contact, improved finger life, substantially lower contact resistance over the life of the finger, elimination of certain kinds of catastrophic failure, substantially improved CRV and improved contact finger tracking.

BRIEF DESCRIPTION OF THE DRAWING

FIG. 1 is a perspective view of a rotary cermet potentiometer;

FIG. 2 is an exploded perspective view of the potentiometer of FIG. 1;

FIG. 3 is a perspective of the wiper assembly of the present invention mounted in a support member;

FIG. 4 is a top plan view of the wiper element according to the present invention;

DETAILED DESCRIPTION OF THE INVENTION

Figure 5:
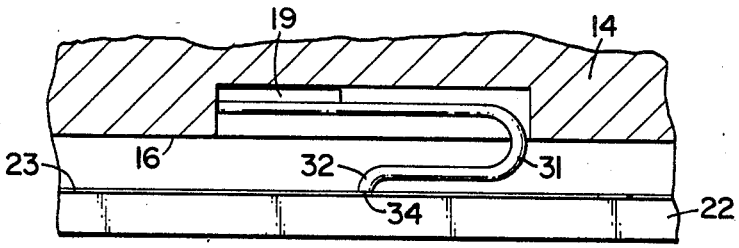
FIG. 5 is a side view of the wiper element in contact with the resistance element according to the present invention.

Referring now to FIGS. 1, 2 and 3 in which like elements have been given like reference numerals there is shown the present invention as preferably employed in a cermet potentiometer 10. Potentiometer 10 includes a housing 12, in which is mounted a rotatable disk-like member or rotor 14 having a slot 15 to receive the tip of a screwdriver or like instrument. On the bottom side 16 of rotatable member 14 there is disposed a wiper assembly 18 which includes a plurality of contact fingers 20.

Potentiometer 10 further includes a ceramic slab or substrate 22 upon which there is deposited an arcuate resistive or resistance element 23 connected at either end through conductive film to a pair of terminals 24 and 25 which are fixed to the substrate. A conductive pad 26 is disposed in the center of substrate 22 and is electrically connected to a center conductor 27.

Preferably, resistance element 23 is of a cermet type. Conductive pad 26 and the other conductive films used to make the required connections between pad 26, element 23 and the respective terminal may also be formed of materials, and deposited by methods, well known in the art.

When assembled, member 14 is nested in housing 12 and is accessible through opening 13. Member 14 is in an axially fixed position sandwiched between substrate 22 and housing 12 in a manner well known in the art. As thus assembled, the contact fingers 20 of wiper assembly 18 are biased by the main bend of the fingers against resistance element 23 and center contact pad 26, with several of the contact fingers contacting the ceramic substrate 22 intermediate thereof. Thus, as rotor 14 is rotated contact fingers 20 wipingly engage resistance element 23 and center conductor 26, whereby the resistance between either pair of terminals 24 and 27 or 25 and 27 may be varied.

Referring now to FIGS. 4 and 5 wiper assembly 18 and its interface with resistance element 23 will be discussed in more detail. Element 18 includes a bus bar 19 to which each of the contact fingers 20 are soldered or welded. The bus bar thus secures the wires into a continuous assembly both mechanically and electrically. Contact fingers 20 are each formed of die drawn wire and are each mounted parallel to one another to form a stri -li array in which each wire in the array is independently biased against the resistance element by the resilient bend 31. Due to contact force requirements by end users of these components the wire diameter is normally in the range of two and one half thousandths (0.0025") to five thousandths (0.005") of an inch in diameter. Thus, each wire contact finger is capable of independently tracking the surface of the resistance element which is known to those skilled in the art provides for lower value of contact resistance and CRV noise.

The key aspect of the present invention is best illustrated in FIG. 5, where it will be seen that each of contact fingers 20 contact resistance element 23 at an endpoint 34. Thus, each finger extends from bus bar 19 through a first main biasing bend 31 and a second approximately 90 degree bend 32 into engagement with resistance element 23 at an endpoint 34. Preferably, there is provided approximately fifteen thousandths of an inch (0.015") of contact length between bend 32 and endpoint 34. As will be readily appreciated by those skilled in the art this endpoint contact aspect of the invention is fundamentally different than the "side" tracking design of the prior art in which the circumferencial surface of the contact finger makes contact with the resistance element.

Figure 6:
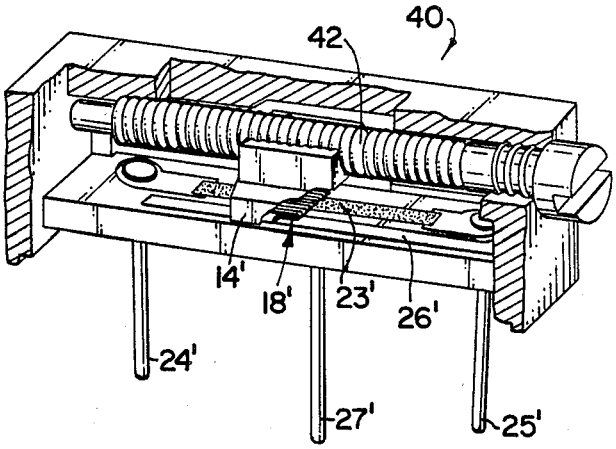
FIG. 6 is a cutaway perspective view of an alternate rectilinear embodiment of the present invention.

Referring briefly to FIG. 6, an alternate "rectilinear" embodiment of the present invention will be explained. Rectilinear potentiometer 40 includes an elongate cermet element 23' and an elongate contact pad 26' spaced apart and adjacent thereto. Element 23' and pad 26' are connected to conductors 24', 25' and 27' in a conventional manner. A slider block 14', equivalent in function to rotor 14, is threadedly engaged with an adjustment lead screw 42 via which the block may be reciprocated along the longitudinal axis the potentiometer. Supported from the slider block 14' is a wiper assembly 18' which is of the same design as wiper assembly 18. Like wiper assembly 18, assembly 18' provides that contact fingers contact element 23' and contact pad 26' at the endpoints thereof. Accordingly, the resistance between contacts 24' and 27' or 25' and 27' may be varied by rotating screw 42.

As indicated above, it has been discovered that the potentiometer of the present invention provides substantial performance advantages over the prior art designs. One such advantage relates to maintaining a low contact resistance between the contact fingers and the resistance element. As may be readily appreciated, the present invention provides for the maintenance of a relatively low contact resistance over the life of the potentiometer because the area contacting the resistance element remains substantially constant as the contact finger is worn against the resistance element, as opposed to the situation encountered in the prior art in which the contact area varies dramatically as the contacts wear from the side. Moreover, it has also been discovered that the contacts wear less quickly in an axial direction as opposed to a side, or radial, direction. This improved wearability is believed to be attributable to the superior resistance of die drawn wire to wear transverse to its longitudinal or axial grain as opposed to its resistance to wear applied parallel to its grain, as is the case in the prior art. Also, whereas the prior art could wear approximately three thousandths of an inch (0.003") before wearing completely through the wire, the present invention provides on the order of one hundreth of an inch (0.010") or more of wearable finger material. Thus, the contact fingers of the present invention not only wear more uniformly and thus maintain low contact resistance, but also have greater durability and therefore a longer lifetime.

Another advantage of the present invention relates to its failure mode. As indicated above, in the prior art semicircular side tracking contact designs tend to fail catastrophically as the contact finger wears through from one side to another. In the present invention, however, catastrophic failure is substantially avoided because the contact fingers wear down in a predictable uniform fashion, never through.

In addition to the above, the present invention also provides for a significant improvement in CRV for reasons not complelely understood at this time. And, it has also been discovered that those contact fingers which lie on the outer end of the wire array tend to track along the perimeter of arcuate resistance element 23 better than side tracking contact designs, which are more prone to flaring out of engagement with the element.

Although the present invention has been described with respect to cermet potentiometers, it is also contemplated that the wiper element design of the present invention would also be advantageous for use in connection with other types of resistance elements such as conductive plastic.

Although the invention has been illustrated with respect to details of its structure and function, it shall be understood that many modifications and changes may be made thereto without departing from the spirit and scope of the invention as set forth in the claims appended hereto.

What is claimed is:

1. A potentiometer comprising:

a housing;

a substrate mounted in said housing and having a resistance element and a conductive element disposed on a surface thereof;

a contact wiper including a plurality of wire contact fingers each connected at a first end to a bus bar and free at the other end;

means for moveably supporting said contact wiper in said housing for wiping contact with said resistance element and said conductive element whereby a circuit is formed from said conductive element to said resistance element; and said fingers in contact with said resistance element supported so that the endpoint of each finger contacts the resistance element with a resilient force.

2. A potentiometer comprising:

a housing;

a substrate mounted in said housing and having a conductive element and a resistance element disposed on a surface thereof;

a contact wiper including plurality of wire contact fingers each connected at a first end to a bus bar and free at the other end, each of said fingers disposed parallel and adjacent to one another and formed to include a resilient bend between said bus bar end and said free end;

means for moveably supporting said contact wiper in said housing for wiping contact with said resistance element and said conductive element whereby a circuit is formed from said conductive element to said resistance element; and the free ends of said fingers in contact with said resistance element so that the endpoint of each finger wipes along the resistance element and so that the tip of the free end is substantially orthogonal to said resistance element whereby the tip of the free end wears in a substantially axial direction.

3. A potentiometer comprising:

a housing;

a substrate mounted in said housing and having a resistance element and a conductive element disposed on a surface thereof;

a contact wiper including a plurality of wire contact fingers each connected at a first end to a bus bar and free at the other end, each of said fingers formed to include a resilient bend therein;

means for moveably supporting said contact wiper in said housing for wiping contact with said resistance element and said conductive element whereby a circuit is formed from said conductive element to said resistance element; and said fingers in contact with said resistance element supported so that the endpoint of each finger contacts the resistance element and so that the finger wears in a substantially axial direction as the endpoint is moved along the resistance element.

4. A potentiometer comprising:

a substrate having an abrasive thick film resistance element disposed thereon;

a contact wiper assembly supported for wiping engagement with said element;

said contact wiper assembly comprising:

(a) a bus bar;

(b) a plurality of wire contact fingers; and (c) each of said fingers connected at a first end to said bus bar and free at the other end and formed to include a resilient bend to cause said free end to wipingly engage with said element at the endpoint thereof to make electrical contact with said element and to cause said free end of said finger to wear in a substantially axial direction as the endpoint is moved along the element.

5. A potentiometer comprising:

a housing;

a substrate mounted in said housing and having a conductive element and an abrasive thick film resistance element disposed on a surface thereof;

a contact wiper including a plurality of wire contact fingers each connected at a first end to a bus bar and free at the other end, each of said fingers disposed parallel and adjacent to one another and formed to include a resilient bend between said bus bar end and said free end;

means for moveably supporting said contact wiper in said housing for wiping contact with said resistance element and said conductive element whereby a circuit is formed from said conductive element to said resistance element; and the free ends of said fingers in contact with said resistance element so that the endpoint of each finger wipes along the resistance element and so that the tip of the free end is substantially orthogonal to said resistance element whereby the tip of the free end wears in a substantially axial direction.

6. A cermet potentiometer comprising:

a housing;

a substrate mounted in said housing and having a cermet resistance element and a conductive element disposed on a surface thereof;

a contact wiper including a plurality of wire contact fingers each connected at a first end to a bus bar and free at the other end;

means for moveably supporting said contact wiper in said housing for wiping contact with said resistance element and said conductive element whereby a circuit is formed from said conductive element to said resistance element; and said fingers in contact with said resistance element supported so that the endpoint of each finger contacts the resistance element with a resilient force.

7. A cermet potentiometer comprising:

a housing;

a substrate mounted in said housing and having a conductive element and a cermet thick film resistance element disposed on a surface thereof, portions of said conductive element and said resistance element proximate one another;

a contact wiper including a plurality of wire contact fingers each connected at a first end to a bus bar and free at the other end, each of said fingers disposed parallel and adjacent to one another and formed to include a resilient bend between said bus bar end and said free end;

means for moveably supporting said contact wiper in said housing for wiping contact with said resistance element and said conductive element along said proximate portions whereby a circuit is formed from said conductive element to said resistance element through said bus bar; and the free ends of said fingers in contact with said resistance element so that the endpoint of each finger wipes along the resistance element and so that the tip of the free end wears on a substantially axial direction.

8. The potentiometer according to claims 1, 2, 3, 5, 6 or 7 further including resistance element terminal means for connecting said resistance element to an electrical circuit and conductive element terminal means for connecting said conductive element to an electrical circuit so that the resistance between said resistance element terminal means and said conductive element terminal means changes as said contact wiper is moved.

9. The potentiometer according to claim 8 wherein said contact fingers are formed of die drawn wire.

10. The potentiometer according to claim 4 further including resistance element terminal means for connecting said resistance element to an electrical circuit and contact wiper connection means for connecting said contact wiper to an electrical circuit so that the resistance between said terminal means and said contact wiper changes as said contact wiper is moved.

11. A potentiometer comprising:

a housing;

a substrate mounted in said housing and having a resistance element supported on a surface thereof;

a contact wiper including a plurality of contact fingers having free ends;

resistance element terminal means for connecting said resistance element to an electrical circuit;

contact wiper connection means for connecting said contact wiper to an electrical circuit;

means for moveably supporting said contact wiper in said housing for wiping contact with said resistance element so that the resistance between said terminal means and said contact wiper changes as the contact wiper is moved; and said fingers in contact with said resistance element supported so that the endpoint of each finger contacts the resistance element with a resilient force.

12. The potentiometer according to claim 11 wherein said fingers include a resilient bend.

13. The potentiometer according to claim 11 wherein the free ends of said fingers are in contact with said resistance element so that the endpoint of each finger wipes along the resistance element and so that the tip of the free end is substantially orthogonal to said resistance element whereby the tip of the free end wears in a substantially axial direction.

14. The potentiometer according to claim 11 wherein said contact fingers are disposed parallel and adjacent to one another.

15. The potentiometer according to claim 14 wherein the free ends of said fingers are in contact with said resistance element so that the endpoint of each finger wipes along the resistance element and so that the tip of the free end is substantially orthogonal to said resistance element whereby the tip of the free end wears in a substantially axial direction.

16. The potentiometer according to claim 11, 12, 13, 14 or 15 wherein said contact fingers are formed of die drawn wire.

17. The potentiometer according to claims 11, 12, 13, 14 or 15 wherein said resistance element is formed of an abrasive thick film.

18. The potentiometer according to claim 17 wherein said abrasive thick film is a cermet material.

19. The potentiometer according to claim 11, 12, 13, 14 or 15 wherein said contact fingers are formed of die drawn wire and wherein said resistance element is formed of an abrasive thick film.

* * * * *

UNITED STATES PATENT AND TRADEMARK OFFICE

CERTIFICATE OF CORRECTION

PATENT NO. : 4,679,024

DATED : July 7, 1987

INVENTOR(S) : Karl A. Kittleson

It is certified that error appears in the above-identified patent and that said Letters Patent is hereby corrected as shown below:

Column 1, line 57, "applica-tions" should be --applications--.

Column 2, line 12, "tips of the axes" should be --axes of the tips--.

Column 3, line 17, "str -li" should be --strip-like--.

Column 6, line 65, insert --assembly-- after "wiper".

Column 6 line 67, insert --assembly-- before "changes" and before "is".

Signed and Sealed this

Twenty-third Day of February, 1988

*Attest:*

DONALD J. QUIGG

*Attesting Officer*

*Commissioner of Patents and Trademarks*